United States Patent [19]

French

[11] 4,304,800

[45] Dec. 8, 1981

[54] METHOD FOR REMOTELY MARKING A DEFECTIVE HEAT EXCHANGER TUBE

[75] Inventor: Larry A. French, Newport News, Va.

[73] Assignee: Davis, French and Associates, Inc., Hampton, Va.

[21] Appl. No.: 98,060

[22] Filed: Nov. 28, 1979

Related U.S. Application Data

[62] Division of Ser. No. 968,304, Dec. 11, 1978.

[51] Int. Cl.[3] ..... B05D 1/28

[52] U.S. Cl. ..... 427/282; 427/287; 427/300; 427/429

[58] Field of Search ..... 427/7, 282, 287, 300, 427/429; 118/205, 256, 211, DIG. 11, DIG. 13, 712, 264, 241, 713; 156/296, 304, 546; 414/749; 73/40.5 A, 620

[56] References Cited

U.S. PATENT DOCUMENTS

| | | | |
|---|---|---|---|
| 3,498,866 | 3/1970 | Kilbane | 118/DIG. 11 |
| 3,817,210 | 6/1974 | Greever | 118/408 |
| 3,934,731 | 1/1976 | Muller et al. | 414/749 |
| 3,964,293 | 6/1976 | Faure et al. | 73/40.5 A |
| 3,984,008 | 10/1976 | Syun-ichi et al. | 414/749 |
| 4,036,373 | 7/1977 | Taenzi et al. | 192/130 |
| 4,056,972 | 11/1977 | Bromwich | 73/620 |

*Primary Examiner*—Ralph S. Kendall

*Attorney, Agent, or Firm*—Richard M. Foard

[57] ABSTRACT

A remotely controlled tool for marking the location of defective tubes in a heat exchanger tube sheet, comprising an axially extensible pilot which is extended into and retracted from the defective tube to be marked by means of an internally threaded captive nut, which is attached to the pilot and is in threaded engagement with an externally threaded drive screw. The drive screw is driven by a reversible drive motor. Marking of a tube is accomplished by means of a paint-saturated annular felt marking pad carried in a cylindrical sleeve which surrounds and is axially slideable with respect to the pilot. The marking pad is driven outwardly along the pilot to engage the tube sheet surrounding the defective tube and is retracted after the marking function has been performed by means of a solenoid. The entire marking tool is carried on a conventional remotely controlled arm mounted in the heat exchanger header compartment, and the tool is positioned opposite the defective tube to be marked by means of the remotely controlled arm with the aid of a television camera mounted on the arm.

9 Claims, 3 Drawing Figures

METHOD FOR REMOTELY MARKING A DEFECTIVE HEAT EXCHANGER TUBE

This is a division of application Ser. No. 968,304, filed Dec. 11, 1978.

BACKGROUND OF THE INVENTION

In order to ensure their safe operation, nuclear power plants are subject to very stringent safety regulations and inspections. These plants are periodically inspected in order to ensure their proper operation and to protect plant workers and the environment from the hazardous effects of leakage of radioactive material. As part of this routine inspection program, the steam generators of nuclear power plants are regularly inspected for leakage in the heat exchanger tubes and for tubes which are potentially defective. This inspection is usually accomplished by means of remotely controlled eddy current testing apparatus. As defective tubes are discovered by means of the eddy current testing apparatus, their position is noted so that they may be plugged at the completion of the test program. In order to ensure that the correct tube is plugged, it is necessary that they be marked or otherwise identified visually so that workers may insert the applicable plugging device into the proper tube. It is very important that the inside of the heat exchanger tubes be kept free from contamination of any kind during the inspection and marking operations, as contamination of the inside of the tubes from any source, such as paint used to mark the tubes for plugging, would interfere with the seal of the plugging device used and, therefore, may result in a plugged tube which continues to leak and pose a safety hazard. At the present time, the only workable method for accomplishing the marking operation is for workers to enter the steam generator header compartments in order to identify and mark the defective tubes for later plugging. This marking operation constitutes a serious health hazard to the workers involved as the steam generator is generally contaminated with radioactive material.

In order to protect the health of the workers involved and to comply with the limitations imposed on personnel exposed to radiation as specified by the Nuclear Regulatory Commission, it is necessary that several individuals be employed to perform the marking operation. As many as eight or more workers may be required to complete the marking of defective tubes in a single steam generator. Each worker must be replaced once he has reached the maximum levels of radiation exposure specified by the Nuclear Regulatory Commission for a calendar quarter, and once he has reached this maximum level of exposure, he may not again be safely exposed to further radiation until the next calendar quarter. Thus, several "new" men who have never before performed the marking operation must be hired and trained for each overhaul and inspection. Hence, it may be seen that the performance of this tube marking operation unnecessarily hazards the health of workers performing the task and entails considerable expense to train personnel who are useful for only a limited time.

At present, there are no devices available to replace human workers in performing the marking function; however, there are available various apparati and systems capable of remotely examining steam generator tubes for existing or potential defects, thereby greatly reducing human contact with radioactive material during the testing process. It is clearly disadvantageous to use human workers to mark the defective tubes, due to the potential hazards to their health and the fact that once the workers have reached this maximum level of radiation exposure, they may no longer be used to perform the marking operation until the next calendar quarter.

SUMMARY OF THE INVENTION

Accordingly, one object of the present invention is to provide an apparatus and method for remotely marking defective tubes to be plugged in a nuclear power plant steam generator.

Another object of the present invention is to eliminate or minimize the exposure of human workers to potentially dangerous radiation.

Yet another object of the present invention is to reduce the overall costs of nuclear power plant maintenance and repair.

According to one embodiment of the present invention, the foregoing and other objects are attained by providing a tool body detachably mounted on a conventional remotely controlled arm located within the header compartment of a nuclear power plant steam generator. The tool body is provided with an axially extensible cylindrical pilot, which is extended axially outward and retracted axially inward by means of a reversible drive screw and a captive nut. The drive screw is rotated in either a clockwise or a counterclockwise direction by means of a reversible electric drive motor. A cylindrical sleeve, in which a paint-saturated felt marking pad is mounted, is circumferentially disposed around the cylindrical pilot and is axially slideable with respect to the pilot. An electric solenoid is provided to thrust the slideable cylindrical sleeve axially outward and to retract the sleeve axially inward with respect to the cylindrical pilot in order to mark the defective tube.

In order to mark a defective heat exchanger tube for later plugging, the cylindrical pilot is positioned under the predetermined defective tube by means of the remotely controlled arm, with the aid of a remote television camera mounted on the arm. Once the pilot is correctly positioned beneath the defective tube, the drive screw drive motor is energized so as to propel the cylindrical pilot axially outward until it is firmly seated in the end of the defective tube, where said tube protrudes through the heat exchanger tube sheet. The solenoid is then energized, thereby thrusting the slideable cylindrical sleeve carrying the paint-saturated felt marking pad axially outward with respect to the seated pilot, until the saturated felt pad contacts the tube sheet surrounding the defective tube. This operation marks the tube sheet with a ring of paint surrounding the defective tube. After the saturated felt marking pad has contacted the tube sheet, the solenoid is de-energized, thereby retracting the slideable cylindrical sleeve axially inward to its rest position. The drive screw drive motor is then re-energized so as to rotate the drive screw in the opposite direction and retract the cylindrical pilot axially inward from its seated position in the defective tube. Once the pilot has been retracted a distance sufficient to clear the ends of the heat exchanger tubes as they protrude through the tube sheet, the tool is ready to be positioned under another defective tube to be marked.

Various other objects and advantages of this invention will appear from the following detailed description of the preferred embodiment thereof when considered in connection with the accompanying drawings.

DESCRIPTION OF THE PREFERRED EMBODIMENT

Figure 1:
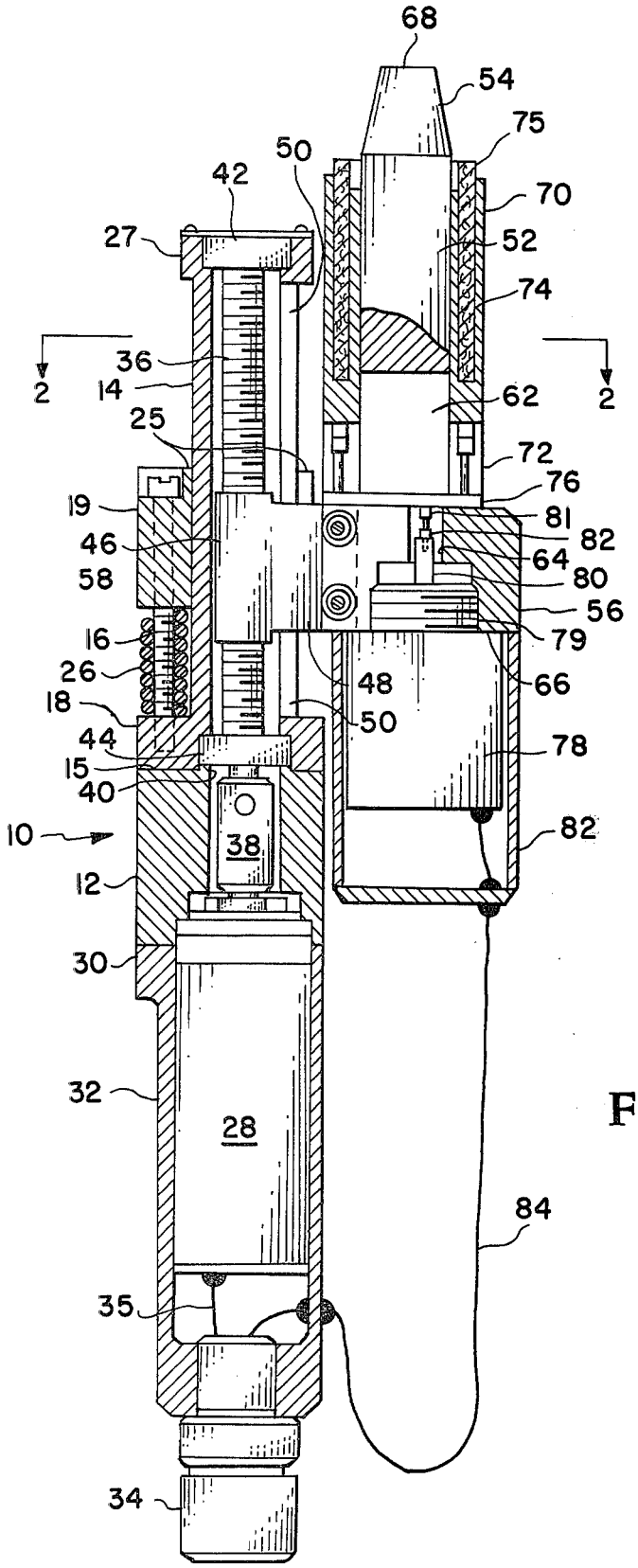
FIG. 1 is a cutaway elevation view of a remotely controllable marking tool constructed according to the present invention.
Figure 2:
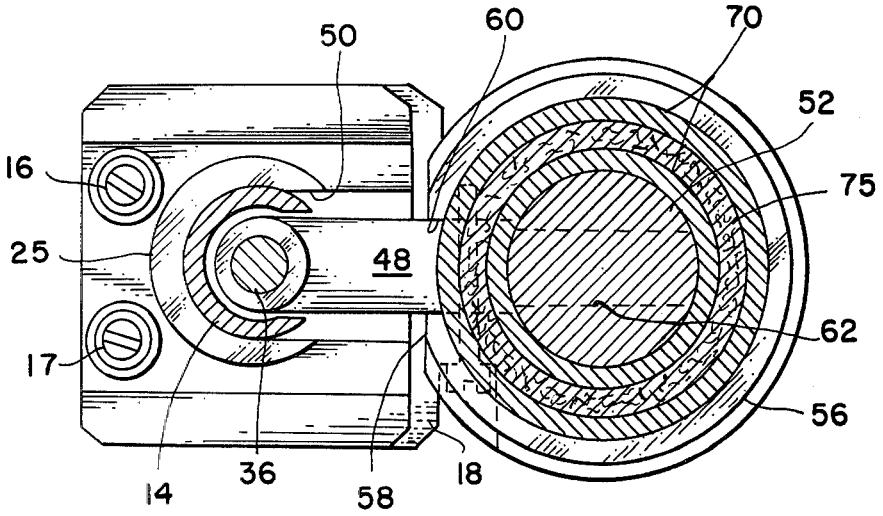
FIG. 2 is a sectional view along line 2—2 of FIG. 1.
Figure 3:
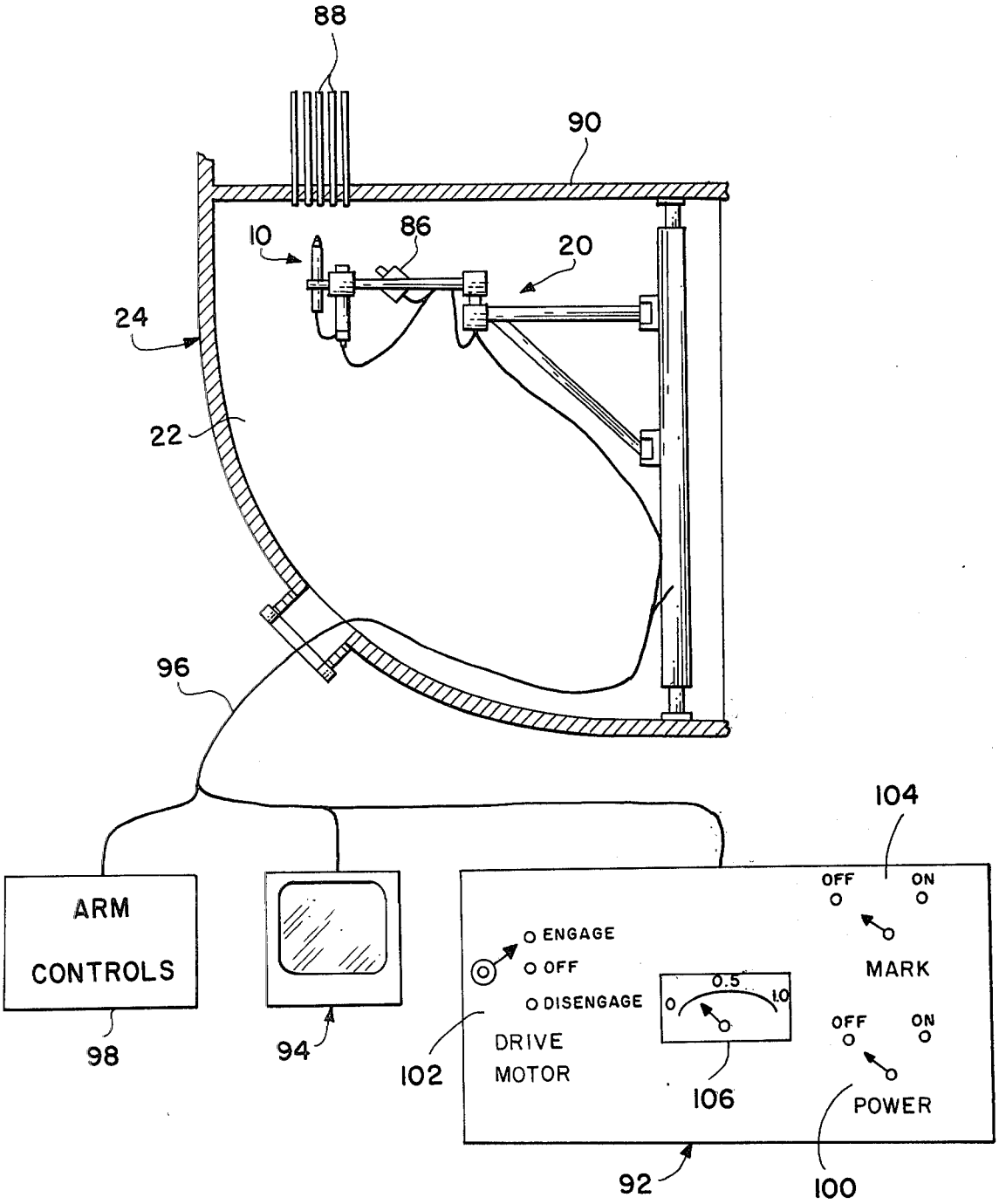
FIG. 3 is a schematic perspective view showing a remotely controllable marking tool positioned on a conventional remotely controlled arm within the header compartment of a heat exchanger.

Referring now to the drawings wherein like reference characters designate identical or corresponding parts, and more particularly to FIGS. 1, 2 and 3, the remotely controllable tool for marking the location of defective tubes in a heat exchanger, designated generally by the reference numeral 10, is comprised basically of a tool body 12, constructed of aluminum or other suitable material, having an axially slotted, cylindrical drive screw housing 14 mounted, by means of cap screws or other suitable fasteners, on the upper surface 15 of said tool body 12. Drive screw housing 14 may be constructed of stainless steel of other suitable material and is provided with two shoulder cap screws 16 and 17 which are threadably mounted in boss 18 at the lower end of drive screw housing 14.

Mounting lug 19, constructed of aluminum or other suitable material, is slideably mounted on shoulder screws 16 and 17, and is restricted in its upward movement by the heads of shoulder screws 16 and 17. A pair of compression coil springs 26 are each coaxially mounted on shoulder screws 16 and 17, so as to bear against the upwardly disposed surface of boss 18 and the downwardly disposed surface of mounting lug 19. Springs 26 operate so as to bias mounting lug 19 upwardly at its upper limit of travel. Mounting lug 19 is provided with a partially circular boss 25 which is approximately equal in diameter to the diameter of boss 27 at the upper end of drive screw housing 14. Bosses 25 and 27 and the diameter of cylindrical drive screw housing 14 are sized to fit the retaining recesses and slot width, respectively, of the mounting bracket (not shown) of a conventional remotely controlled arm, designated generally by the reference numeral 20, in order to permit the detachable mounting of tool 10 on remotely controlled arm 20. Tool 10 is mounted in a conventional mounting bracket (not shown) on remotely controlled arm 20, by depressing mounting lug 19 downwardly against the bias of springs 26, sliding cylindrical drive screw housing 14 into the mounting bracket slot, and then releasing mounting lug 19 so as to allow bosses 25 and 27 to engage circular recesses provided in the upper and lower surfaces of the mounting bracket.

Remotely controlled arm 20 is located within the header compartment 22 of a heat exchanger, designated generally by the reference numeral 24, whose tubes 88 are to be marked. Remote control arm 20 provides the means for locating tool 10 in a position to perform its marking function, as will be explained in greater detail hereinbelow.

A reversible direct current electric drive motor 28 is mounted on the lower surface 30 of tool body 12 within motor housing 32. Drive motor 28 and motor housing 32 are mounted on tool body 12 by means of cap screws or other suitable means, and motor housing 32 may be constructed of aluminum or other satisfactory material. Motor housing 32 is provided with connector terminal 34 as a means of supplying drive motor 28, and other parts of this invention to be more fully explained hereinbelow, with electric power.

Drive motor 28 is drivingly connected through an aperture 40 in tool body 12 to an externally threaded drive screw 36 by means of a conventional sleeve coupling 38. Drive screw 36 extends upwardly from the upper surface 15 of tool body 12 and is wholly enclosed within drive screw housing 14. Drive screw 36 is further rotatively mounted on upper and lower anti-friction bearings, 42 and 44 respectively, which bearings are in turn mounted in recesses in the upper and lower ends of drive screw housing 14. Drive screw threadably engages an internally threaded captive nut 46, made of brass or other suitable material. Captive nut 46 is provided with an elongated tab 48 which protrudes radially outward with respect to drive screw 36 and extends through an axial slot 50 in drive screw housing 14. Thus, as drive screw 36 is rotated by drive motor 28, the interference between the sides of slot 50 and captive nut tab 48 prevents the rotation of captive nut 46 with respect to drive screw 36, thereby constraining captive nut 46 to move in either an upward or downward axial direction, depending upon the direction of rotation of drive screw 36.

Cylindrical pilot 52 is provided with a circumferential chamfer 54 at its upwardly disposed end and is further provided at its lower end with an integral semi-cylindrical boss 56 of substantially larger diameter than the diameter of pilot 52 and having a chordal flat 58 machined into one side thereof. A radial slot 60, sized to accept captive nut tab 48, is cut into chordal flat 58 of semi-cylindrical boss 56. Cylindrical pilot 52 is fixedly mounted on captive nut tab 48 by means of the male-female fit of captive nut tab 48 and radial slot 60 in conjunction with cap screws or other suitable fasteners. The lower portion of cylindrical pilot 52 is further provided with an axially elongated slot 62 passing diametrically entirely through the pilot cylinder and an axially disposed, but not necessarily coaxial, hole 64 extending upwardly from the lower, or downwardly disposed, surface 66 of semi-cylindrical boss 56 to an intersection with axial slot 62. Cylindrical pilot 52 may be constructed of aluminum, steel or other suitable material. It should be noted that the diameter of cylindrical pilot 52 and the amount of taper in chamfer 54 must each be correctly sized with respect to the heat exchanger tubes to be marked. The outside diameter of pilot 52 must exceed the inside diameter of the heat exchanger tubes to be marked, and it is preferable that the diameter exceed the outside diameter of the heat exchanger tubes by at least 1/16 inch. Furthermore, the diameter of the upwardly disposed, tapered end 68 of cylindrical pilot 52 must be smaller than the inside diameter of the heat exchanger tubes, and preferably should be at least 1/16 inch smaller in diameter.

A cylindrical sleeve marking pad holder 70, having both ends open, is circumferentially disposed around the upper portion of cylindrical pilot 52. Similarly, cylindrical thrust sleeve 72 is circumferentially disposed around the lower portion of cylindrical pilot 52. Both marking pad holder 70 and thrust sleeve 72 are axially slideable with respect to cylindrical pilot 52, and mounting pad holder 70 is provided with an annular recess 74 in its outwardly disposed, or upward, end, which recess extends, in a downward direction within the wall of said marking pad holder 70. Both marking pad holder 70 and thrust sleeve 72 are constructed of nylon; however, they may be constructed of aluminum or other suitable material. Recess 74 of marking pad holder 70 is fitted with a cylindrical felt marking pad 75. Felt pad 75 is saturated with paint or other suitable marking fluid in order to mark the defective heat exchanger tube.

Thrust sleeve 72 is fixedly attached at its lower, inwardly disposed end to thrust bar 76. Thrust bar 76 is located within axial slot 62 of cylindrical pilot 52 and is fastened to the lower end of thrust sleeve 72 by means of cap screws or other suitable fasteners. Thrust bar 76 is constructed of stainless steel however, any other suitable material may be substituted. By referring to FIG. 1, it may readily be seen that thrust sleeve 72 may be displaced axially in either direction with respect to cylindrical pilot 52 until thrust bar 76 contacts the upper or lower end of axial slot 62. As may also be readily seen from FIG. 1, the upper, outwardly disposed end of thrust sleeve 72 is in direct contact with the lower, inwardly disposed end of marking pad holder 70, thereby permitting the direct transfer of any upward force applied to thrust bar 76 directly to marking pad holder 70.

Actuation of marking pad holder 70 is accomplished, via thrust sleeve 72 and thrust bar 76, by means of electric solenoid 78 and solenoid plunger 80. Solenoid 78 is mounted on the lower surface 66 of cylindrical boss 56 by means of threaded nipple 79; however cap screws or other suitable fasteners may be substituted. Solenoid 78 is positioned such that its plunger 80 extends upwardly through axial hole 64 to within 0.010 inches of contacting the downwardly disposed side of thrust bar 76. Solenoid 78 is mounted within solenoid housing 82, which is attached to the downwardly disposed surface 66 of semi-cylindrical boss 56 with cap screws or other suitable fasteners and may be constructed of aluminum or other satisfactory material. Electric power is supplied from connector plug 34 to solenoid 78 by means of power cable 84.

In its "at rest", or un-energized, mode, as shown in FIG. 1, plunger 80 is retracted to the maximum extent possible within the body of solenoid 78. Solenoid plunger 80 is provided with an externally threaded adjustment screw 81 and lock nut 83 in order that the overall length of plunger 80 and the clearance between the head of adjustment screw 81 and thrust bar 76 may be adjusted. It is desirable that the overall length of plunger 80 be sized such that when plunger 80 is in its normally retracted position within solenoid 78, the clearance between the head of adjustment screw 81 and the downwardly disposed surface of thrust bar 76 does not exceed 0.010 inch. Thus, when plunger 80 is in its normally retracted position, thrust sleeve 72 will rest by the action of gravity upon the upper surface of semi-cylindrical boss 56.

Upon the actuation of solenoid 78, plunger 80 extends vertically upward into contact with thrust bar 76, thereby forcing thrust bar 76, thrust sleeve 72, and marking pad holder 70 vertically upward with respect to cylindrical pilot 52. It is desirable, but not strictly necessary, that the axial length of slot 62 and the upward stroke of plunger 80 be sized such that when plunger 80 is at the upwardmost limit of its stroke, the upper end felt marking pad 76 extends upwardly beyond the upwardly disposed end 68 of cylindrical pilot 52. In order to ensure the correct operation of this invention, it is strictly necessary only that axial slot 62 and stroke of plunger 80 be sufficiently long to allow the upper end of felt marking pad 74 to extend upwardly a sufficient distance to contact the tube sheet surrounding the defective tube to be marked when cylindrical pilot 52 seated in the defective tube.

Referring now to FIG. 3, it may be seen that marking tool 10 is mounted on a conventional, remotely controlled, telescoping, double articulated arm 20 within the header compartment 22 of heat exchanger 24. Remote television camera 86 is also mounted on arm 20 and is aimed so as to be capable of viewing the ends of heat exchanger tubes 88 as they protrude through tube sheet 90, as well as simultaneously viewing the upwardly disposed end of cylindrical pilot 52. Marking tool 10 and remote television camera 86 are connected to remote marking tool control console, indicated generally by the reference numeral 92, and remote television readout 94, respectively, by means of gang cable 96. Remote control arm 20 is also connected to a remote control station, shown schematically by reference numeral 98, by means of gang cable 96. By virtue of its telescoping and double-articulated features, control arm 20 is capable of being positioned under any given part of tube sheet 90.

Remote marking tool control console 92 includes an AC to DC rectifier and further comprises three manual switches: A two positioned main power switch 100, a three positioned drive motor switch 102, and a two positioned marking switch 104; together with an automatic current limiting switch (not shown) in series with the drive motor 28 circuit and a drive motor circuit ammeter 106. Main power switch 100 may be manually positioned to either interrupt or supply main alternating current to remote console 92. Drive motor switch 102 controls the direct current circuit to drive motor 28, and may be manually positioned to interrupt current to drive motor 28, or to supply drive motor 28 with direct current with either positive or negative polarity so as to rotate drive screw 36 in either a clockwise or counterclockwise direction as desired by the operator. Marking switch 104 controls the direct current circuit to solenoid 78 and may be manually positioned to either interrupt or supply direct current to solenoid 78. The direct current circuit for drive motor 28 is further provided with an ammeter 106 and an automatic current limiting switch (not shown) which operates to interrupt direct current power to drive motor 28 once a preset line current has been exceeded.

OPERATION

In operation, remote marking tool 10 is mounted, by means of cylindrical lug 16 and coil springs 26, on remotely controlled arm 20 within header compartment 22 of heat exchanger 24 and connected to power cable 96. Remote marking tool control console 92 is also connected to power cable 96 and placed, along with remote television readout 94 and remote arm control station 98, at least 100 feet from header compartment 22, in order to reduce the affects of radiation on the operator.

Control arm 20 is positioned by the operator with the aid of television camera 86, so that the upwardly disposed end of cylindrical pilot 52 is directly beneath the end of the particular heat exchanger tube to be marked as it protrudes downwardly through tube sheet 90. As set forth here and above, the defective tubes to be marked have previously been determined by means of remote eddy current testing or other suitable testing procedures.

Once the operator is satisfied that cylindrical pilot 52 is correctly aligned with the defective tube to be marked, drive motor switch 102 is actuated so as to energize drive motor 28 and turn drive screw 36 in the proper direction to extend cylindrical pilot 52 axially upward. Chamfer 54 of cylindrical pilot 52 serves to further align pilot 52 with the defective tube as pilot 52 is extended axially upward into seated engagement with the protruding end of the defective tube. Switch 102 remains on and drive motor 28 remains energized until pilot 52 engages the defective tube and seats itself. Due to the rigidity of control arm 20, drive motor 28 begins to stall thus drawing more current as pilot 52 becomes more firmly seated in the defective tube. The automatic current limiting switch de-energizes drive motor 28 once the preset motor current level has been achieved, thus automatically controlling pilot engagement pressure.

Once pilot 52 has been satisfactorily seated in the end of the defective tube to be marked, the operator actuates marking switch 104 to energize solenoid 78, thereby forcing felt marking pad 76, which is saturated with paint or other suitable marking fluid, into contact with tube sheet 90 and leaving a circular mark on tube sheet 90 surrounding the defective tube. Upon deactuating marking switch 104 and de-energizing solenoid 78, felt marking pad 76, marking pad holder 70 and thrust sleeve 72 are returned to their rest position by the action of gravity. After the operator is satisfied with the quality of the mark, drive motor switch 102 is then reactuated so as to reverse the direct current polarity to drive motor 28 and retract pilot 52 from its seated engagement with the defective tube. As soon as pilot 52 has cleared the protruding ends of heat exchanger tubes 88 by a sufficient margin, remote marking tool 10 is ready to be positioned under the next defective tube to be marked.

Obviously, numerous modifications of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for remotely marking a defective heat exchanger tube within a heat exchanger header compartment comprising the steps of:

locating the defective tube to be marked;

positioning marking apparatus in proximity to said defective tube;

sealing said defective tube against internal contamination; and applying marking fluid in proximity to the exterior of said defective tube.

2. The method according to claim 1 wherein the step of locating the defective tube to be marked comprises the steps of providing a television camera and a remote television receiver; aiming said television camera so as to be capable of viewing the ends of said heat exchanger tubes as they protrude through the tube sheet of said heat exchanger into said heat exchanger header compartment; and visually sighting the end of said defective heat exchanger tube by means of said television camera and remote television receiver.

3. The method according to claim 2 wherein the step of positioning marking apparatus in proximity to said defective heat exchanger tube comprises the steps of providing a remotely controlled arm within said heat exchanger header compartment; mounting said marking apparatus on said remotely controlled arm; and maneuvering said remotely controlled arm such that said marking apparatus is aligned with the end of said defective heat exchanger tube as it protrudes through the tube sheet of said heat exchanger into said heat exchanger header compartment; and visually verifying the position of said marking apparatus with respect to the end of said defective heat exchanger tube by means of said television camera and remote television receiver.

4. The method according to claim 3 wherein the step of sealing said defective heat exchanger tube against internal contamination comprises the steps of providing a sealing apparatus comprising an axially extensible cylindrical pilot having an outside diameter larger than the inside diameter of said defective heat exchanger tube and further having a circumferential chamfer at its outwardly disposed end, the minimum diameter of said chamfer being smaller than the inside diameter of said defective heat exchanger tube, and extending said chamfered cylindrical pilot outwardly into mechanical contact with the end of said defective heat exchanger tube as it protrudes through the tube sheet of said heat exchanger into said heat exchanger header compartment so as to seat the chamfered end of said cylindrical pilot in the bore of said defective heat exchanger tube; and wherein the step of applying marking fluid in proximity to the exterior of said defective heat exchanger tube comprises the steps of providing a porous pad, saturating said porous pad with paint, and forcing said porous pad saturated with paint into mechanical contact with the tube sheet of said heat exchanger surrounding said defective heat exchanger tube.

5. The method according to claim 1 wherein the step of positioning marking apparatus in proximity to said defective heat exchanger tube comprises the steps of providing a remotely controlled arm within said heat exchanger header compartment; mounting said marking apparatus on said remotely controlled arm; and maneuvering said remotely controlled arm such that said marking apparatus is aligned with the end of said defective heat exchanger tube as it protrudes through the tube sheet of said heat exchanger into said heat exchanger header compartment.

6. The method according to claim 1 wherein the step of sealing said defective heat exchanger tube against internal contamination comprises the step of mechanically occluding the bore of said defective heat exchanger tube.

7. The method according to claim 1 wherein the step of sealing said defective heat exchanger tube against internal contamination comprises the steps of providing a sealing apparatus comprising a cylindrical pilot having an outside diameter larger than the inside diameter of said defective heat exchanger tube; and placing said cylindrical pilot in mechanical contact with the end of said defective heat exchanger tube as it protrudes through the tube sheet of said heat exchanger into said heat exchanger header compartment so as to occlude the bore of said defective tube.

8. The method according to claim 1 wherein the step of sealing said defective heat exchanger tube against internal contamination comprises the steps of providing a sealing apparatus comprising an axially extensible cylindrical pilot having an outside diameter larger than the inside diameter of said defective heat exchanger tube and further having a cirumferential chamfer at its outwardly disposed end, the minimum diameter of said chamfer being smaller than the inside diameter of said defective heat exchanger tube; and extending said chamfered cylindrical pilot outwardly into mechanical contact with the end of said defective heat exchanger tube as it protrudes through the tube sheet of said heat exchanger into said heat exchanger header compartment so as to seat the chamfered end of said cylindrical pilot in the bore of said defective heat exchanger tube.

9. The method according to claim 1 wherein the step of applying marking fluid in proximity to the exterior of said defective heat exchanger tube comprises the steps of providing a porous pad; saturating said porous pad with paint; and forcing said porous pad saturated with paint into mechanical contact with the tube sheet of said heat exchanger surrounding said defective heat exchanger tube.

* * * * *